US006269542B1

(12) United States Patent
Gamba

(10) Patent No.: US 6,269,542 B1
(45) **Date of Patent: *Aug. 7, 2001**

(54) MULTI-PURPOSE TOOL ASSEMBLY

(76) Inventor: Gregory G. Gamba, 4 Locust Place, Livingston, NJ (US) 07039

( * ) Notice: Subject to any disclaimer, the term of this patent is extended or adjusted under 35 U.S.C. 154(b) by 0 days.

This patent is subject to a terminal disclaimer.

(21) Appl. No.: 09/360,379

(22) Filed: Jul. 23, 1999

Related U.S. Application Data

(60) Division of application No. 08/960,795, filed on Oct. 30, 1997, which is a continuation-in-part of application No. 08/531,933, filed on Sep. 21, 1995, now Pat. No. 5,890,293.

(51) Int. Cl.[7] ..... B26B 1/08
(52) U.S. Cl. ..... 30/125; 30/162; 30/337
(58) Field of Search ..... 30/125, 162, 160, 30/332, 333, 337–339, 58, 59

(56) References Cited

U.S. PATENT DOCUMENTS

| | | | |
|---|---|---|---|
| D. 271,149 | 10/1983 | Castiglione . | |
| 830,451 | 9/1906 | Peterson . | |
| 2,094,260 | 9/1937 | Brody . | |
| 2,133,087 | 10/1938 | Ericsson . | |
| 2,257,314 | 9/1941 | Shinn . | |
| 2,259,050 | 10/1941 | Thurston . | |
| 2,885,778 * | 5/1959 | Randol | 30/58 X |
| 3,667,122 | 6/1972 | Black . | |
| 4,381,604 | 5/1983 | Horst . | |
| 5,093,994 | 3/1992 | Karas . | |
| 5,440,811 | 8/1995 | Challis . | |
| 5,507,096 | 4/1996 | Gamba . | |

* cited by examiner

*Primary Examiner*—Douglas D. Watts
(74) *Attorney, Agent, or Firm*—Lerner, David, Littenberg, Krumholz & Mentlik, LLP

(57) ABSTRACT

A multi-purpose tool assembly enables replaceable attachment of any one of a plurality of tools having the same or different function to a single tool handle assembly. The tool handle assembly is constructed from a U-shaped frame member supporting a pivotable plate which is operative for clamping the shank portion of a tool to the frame member. A plurality of tools may be packaged with a tool handle assembly in the nature of a kit.

24 Claims, 11 Drawing Sheets

MULTI-PURPOSE TOOL ASSEMBLY

This is a divisional application of application Ser. No. 08/960,795 filed Oct. 30, 1997, which is a CIP of application Ser. No. 08/531,933 filed Sep. 21, 1995, now U.S. Pat. No. 5,890,293.

The present invention relates in general to a multi-purpose tool assembly, and more particularly, to a universal tool handle assembly operative to enable ready attachment and/or replacement of any one of a plurality of tools each having the same or different function, while at the same time, securing the tool within the tool handle assembly to enable the use thereof in a variety of operations.

BACKGROUND OF THE INVENTION

Tools are widely used to perform many different functions. For example, tools are used to cut any number of different materials such as hair, clothing, electrical wire, paper, flowers, tree branches, wood products, metal products, carpeting, food, etc. In addition, a variety of tools may be used to perform the functions of scraping, screwing, sawing, hammering, rasping, puncturing, filing, grasping, etc. In order to increase performance, the tool art has become highly specialized so that a different type of tool may be used to best perform each of the above mentioned operations and functions. More particularly, standard garden shears may be used to cut tree branches, prune plants or cut flowers. A scissors may be used for ordinary cutting operations while scissors having a more precision type blade may be used to cut hair or clothing. A hammer or mallet may be used to drive nails. A file may be used to grind metal and wood. A wrench may be used for grasping pipes and bolts. A screwdriver may be used for driving screws. An awl may be used for puncturing holes, etc.

There is known a variety of tools which include a replaceable cutting blade, for example, utility knives used by contractors for various trimming operations and a flush cutter as disclosed in Gamba, U.S. Pat. No. 5,507,096. Common in each of the aforementioned tools is a blade holder assembly operative to enable attachment of the cutting blade to the handle to enable use of the tool, while at the same time, enabling ready removal of the cutting blade when the need for replacement arises, e.g., when the blade becomes worn or broken. In this regard, a blade holder assembly must satisfy two competing objectives, i.e., securing the cutting blade for use while enabling its ready replacement. Although there is known tool handle assemblies which attempt to meet each of these objectives, they typically do not achieve both objectives equally well.

There is also known a variety of tools which perform specific functions, for example, as noted hereinabove. In order to allow use of these tools, each tool includes a working end and a supporting handle portion. The handle supporting portion is often constructed from rigid materials in order to be sufficiently sturdy to meet the functional needs of the tool. This can result in the tool being expensive to manufacture, particularly, when different types of tools include the same handle construction. It would therefore be desirable to construct a tool handle which would meet the demands of the user in a variety of applications by enabling the tool to be replaced with another tool having the same or different function. In this manner, a single tool handle could suffice for use with a plurality of interchangeable tools.

SUMMARY OF THE INVENTION

It is broadly an object of the present invention to provide a multi-purpose tool assembly having a tool handle assembly which equally satisfies the need of securing a tool thereto, while at the same time, allowing the tool to be readily removed for replacement.

Another object of the present invention is to provide a multi-purpose tool assembly having a tool handle assembly which is operative using one's fingers, a conventional screw driver, coin edge or the like to permit tool attachment and replacement.

Another object of the present invention is to provide a multi-purpose tool assembly having a tool handle assembly to which there can be replaceably attached any one of a plurality of tools having the same or different function.

Another object of the present invention is to provide a multi-purpose tool assembly having a tool handle assembly which is inexpensive to manufacture from the fewest number of components.

Another object of the present invention is to provide a multi-purpose tool assembly in the nature of a kit which includes a plurality of tools having different functions for replaceable attachment to the tool handle assembly.

In accordance with one embodiment of the present invention there is described a multi-purpose tool assembly, the assembly comprising a frame member, a tool having a shank removably supported on the frame member, a plate coupled to the frame member arranged overlying at least a portion of the shank, a spring arranged between the shank and the plate, and securing means in operative association with the plate for releasably clamping the shank against the frame member by engagement of at least a portion of the plate with the shank, whereby the tool can be replaced with another tool having a shank by operation of the securing means.

In accordance with another embodiment of the present invention there is described a multi-purpose tool assembly, the assembly comprising a U-shaped frame member, a tool having a shank removably supported on the frame member, a plate pivotably coupled to the frame member overlying at least a portion of the shank, a spring arranged between the shank and the plate and a bolt threadably received through one end of the plate for releasably clamping the shank against the frame member, the bolt having a portion engaging the shank while pivoting the plate such that another end of the plate engages the shank thereby clamping the shank to the frame, whereby the tool can be replaced with another tool having a shank by operation of the securing means.

In accordance with another embodiment of the present invention there is described a multi-purpose tool kit, the kit comprising a frame member, a plurality of tools each having a shank, the tools being separately and removably supported on the frame member, a plate coupled to the frame member arranged overlying at least a portion of the shank, a spring arranged between the shank and the plate, and securing means in operative association with the plate for releasably clamping the shank against the frame member by engagement of at least a portion of the plate with the shank, whereby one of the plurality of tools can be replaced with another one of the plurality of tools by operation of the securing means.

In accordance with another embodiment of the present invention there is described a tool comprising a frame member having a pair of spaced apart openings at one end thereof, a cutting blade including a body having a cutting edge removably supported on the frame member between a first and second position, the cutting edge arranged along a first axis when the body is supported on the frame member between the pair of spaced apart openings and along a second axis substantially transverse to the first axis when the body is supported on the frame member extending through the pair of spaced apart openings, a plate coupled to the frame member arranged overlying at least a portion of the body, and securing means in operative association with the plate for releasably clamping the blade against the frame member when in the first and second positions by engagement of at least a portion of the plate with the body.

BRIEF DESCRIPTION OF THE DRAWINGS

The above description, as well as further objects, features and advantages of the present invention will be more fully understood with reference to the following detailed description of a multi-purpose tool assembly, when taken in conjunction with the accompanying drawings, wherein:

FIG. 13 FIG. 12 is a front elevational view of a tool in the nature of a wide scraper;

DETAILED DESCRIPTION OF THE PREFERRED EMBODIMENTS

Figure 1:
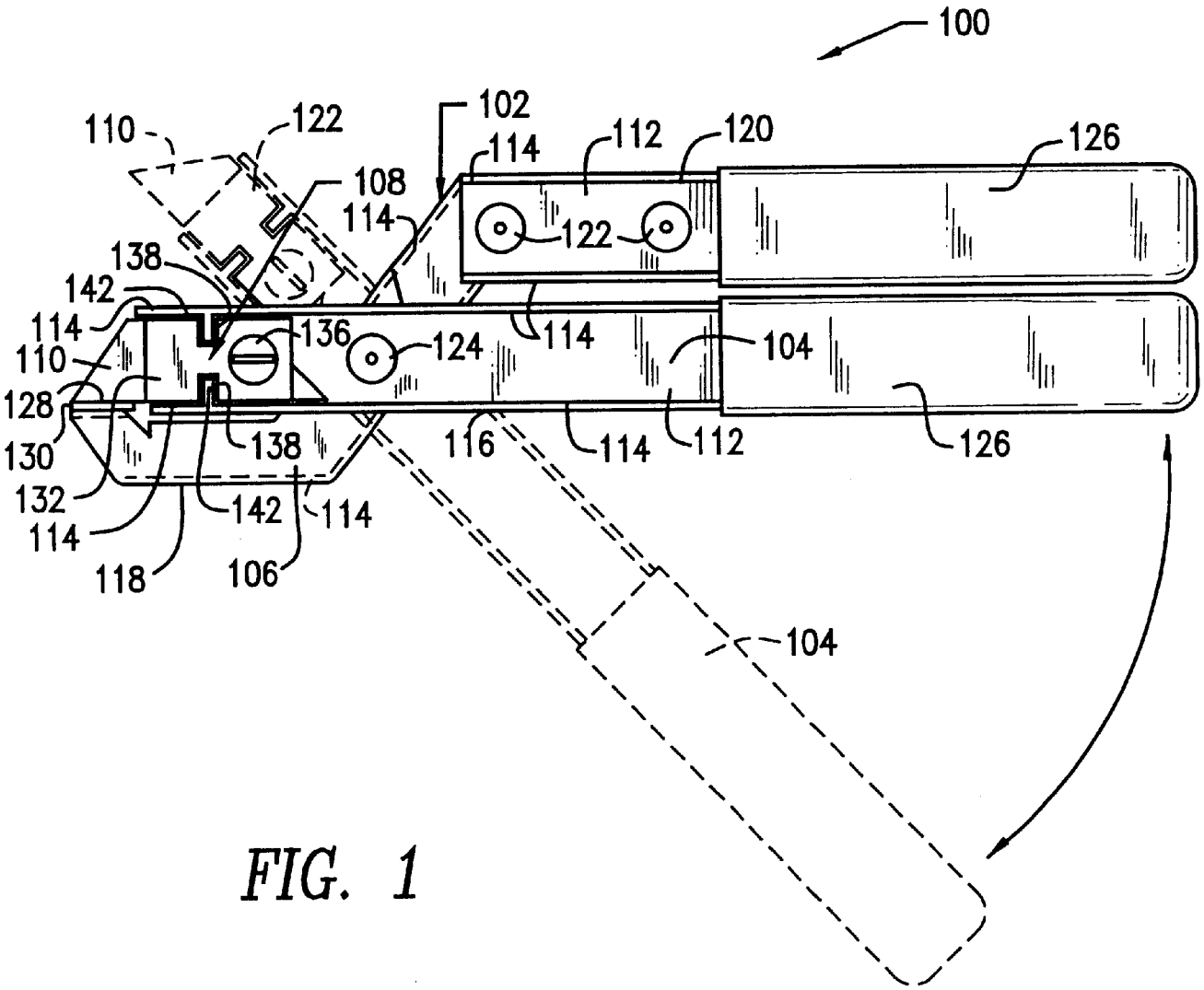
FIG. 1 is a front elevational view illustrating a cutting tool in the nature of a flush cutter having a blade holder assembly constructed in accordance with one embodiment of the present invention.

Turning now to the drawings, wherein like reference numerals represent like elements, there is shown in FIG. 1 a cutting tool generally designated by reference numeral 100 in the nature of a flush cutter of the type disclosed in the aforementioned application. The cutting tool 100 is generally constructed of three basic components, a frame assembly 102 which includes a first frame member 104 and a second frame member 106, a blade holder assembly 108 and a cutting blade 110. The frame members 104, 106 are each constructed from an elongated U-shaped member having a base 112 and a pair of spaced apart legs 114. As a U-shaped member, the frame members 104, 106 are provided with sufficient rigidity and mechanical strength to be useful for the construction of the cutting tool 100, while at the same time, being light in weight.

As shown in accordance with one embodiment, the first frame member 104 is constructed as a single elongated U-shaped member 116, while the second frame member 106 is constructed from a pair of U-shaped members 118, 120 joined back-to-back by means of a plurality of spaced apart rivets 122, or other such suitable means such as screws, bolts, spot welding and the like. It is, however, to be understood that the second frame member 106 may be constructed from a single U-shaped member by bending same at the appropriate locations, and contrary, the first frame member 104 may be constructed from a plurality of joined U-shaped members.

Figure 3:
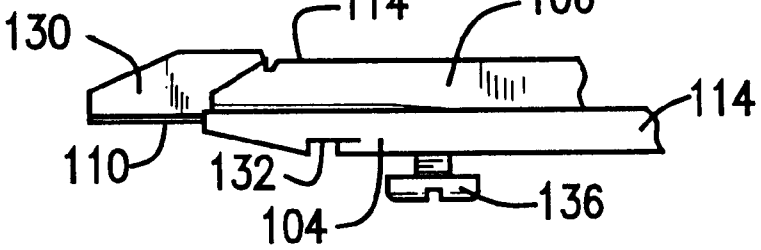
FIG. 3 is a partial top plan view of a flush cutter showing the blade holder assembly constructed in accordance with the present invention.

The frame members 104, 106 are pivotably joined together in back-to-back relationship by a rivet 124, pin, or other such suitable means to enable pivoting of the frame members relative to one another. One end of the frame members 104, 106 is provided with a polymeric sleeve 126 which, in part, defines a handle portion for engagement by the user of the cutting tool 100 so as to manipulate pivotable motion between the frame members 104, 106. The other end of frame member 104 supports a cutting blade 110 which may be of the conventional utility knife type which is readily available. The cutting blade 110 is slidingly received between legs 114 overlying the base 112 of frame number 104. The forward end of the cutting blade 110 extends beyond the frame member 104 so as to expose its lower cutting edge 128. The cutting edge 128 engages an opposing flat anvil 130 (see also FIG. 3) formed from a folded over portion of an extended leg 114 of frame member 106. The anvil 130 provides a cutting surface which is engaged by the cutting edge 128 of the cutting blade 110 upon pivotable manipulation of the frame members 104, 106 during use of the cutting tool 100.

Figure 2:
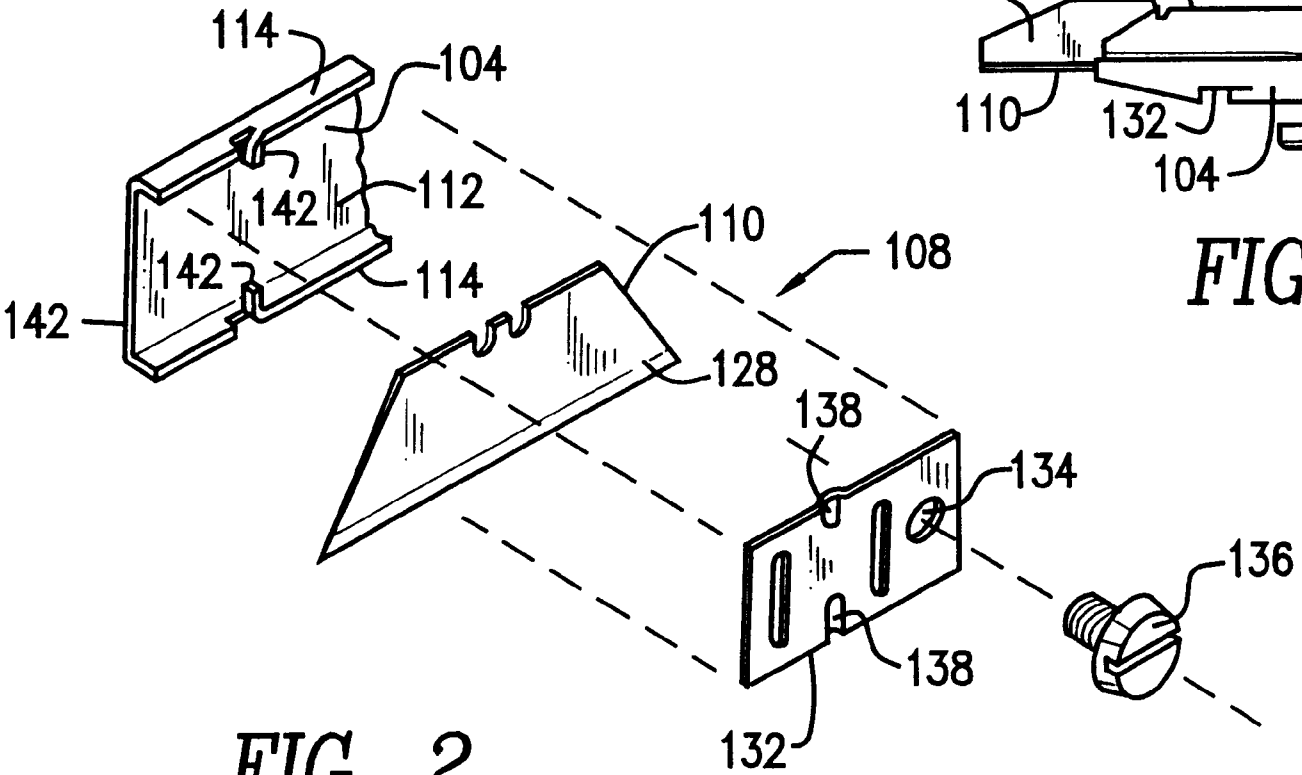
FIG. 2 is an exploded perspective unassembled view of the construction of the blade holder assembly in accordance with the present invention.
Figure 4:
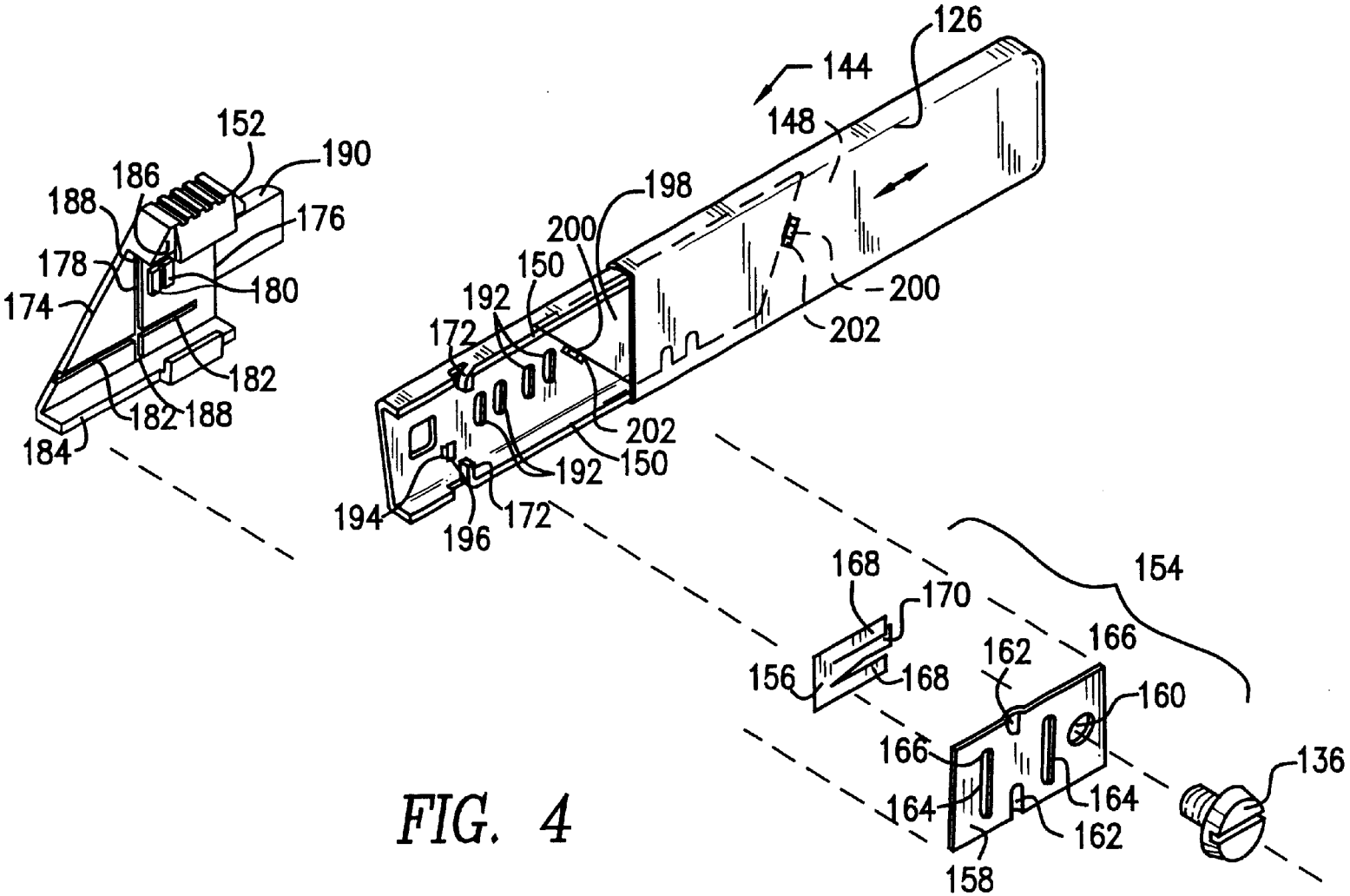
FIG. 4 is exploded perspective unassembled view of a utility knife having a blade holder assembly constructed in accordance with another embodiment of the present invention.

Referring to FIG. 2, the construction of the blade holder assembly 108 is shown in greater detail. The blade holder assembly includes a generally flat rectangular plate 132 sized in width to be received between the spaced apart leg 114 of the frame member 104. The plate 132 is provided with a threaded opening 134 adjacent one end thereof so as to threadingly receive a threaded bolt 136, screw or the like.

Generally within a central portion of the plate 132, a pair of aligned opposing indents 138 are provided extending inwardly from the outer edges of the plate. The plate 132 is received overlying the base 112 adjacent the forward end 140 of the frame member 104. A pair of spaced apart opposing pins 142 are formed by inwardly bending a cutout portion of the legs 114 of the frame member 104. The plate 132 is slid overlying the base 112 and underlying the pins 142 until they are received within the indents 138 to enable the plate to pivot thereabout. The cutting blade 110 may be slidingly received between the plate 132 and the base 112 of the frame member 104. The cutting blade 110 is positioned to provide a portion thereof extending outwardly beyond the forward end 140 of the frame member 104 to expose the cutting edge 128.

The cutting blade 110 is clamped between the plate 132 and frame member 104 by threading the bolt 136 through the threaded opening 134 into engagement with a portion of the blade. As the bolt 136 is rotated, its free end will engage the cutting blade 110 causing the plate to pivot about pins 142 until the opposite end of the plate also engages the cutting blade. At this point, further rotation of the bolt 136 will press the underlying portion of the cutting blade firmly against the base 112 of the frame member 104. Simultaneously, the pivoting action of the plate 132 will press the other end of the plate against another portion of the cutting blade 110 so as to securely clamp the cutting blade to the frame member 104. By rotation of the bolt 136 within the threaded opening 134, the plate 132 is operative for releasably securing the cutting blade 110 to the frame member 104. In this regard, it is to be understood that the greater the distance between the indents 138 and threaded opening 134 will increase the mechanical advantage which can be applied by the bolt 136 to increase the engagement pressure of the other end of the plate against the cutting blade.

The bolt 136 may be of sufficient size to be rotated by one's fingers, a conventional screw driver, coin edge or the like. The cutting blade 110 may be easily removed from the cutting tool 100 by loosening bolt 136 thereby eliminating the clamping action of the plate 132. Although the bolt 136 has been described as acting upon a portion of the cutting blade 110, depending upon the size and shape of the blade, it is possible that the bolt will engage only the base 112 of the frame member 104. In this regard, the bolt 136 will still pivot the plate 132 such that its other end engages a portion of the cutting blade 110 so as to clamp the cutting blade in a secured position.

Referring now to FIGS. 4–7, there is disclosed a cutting tool 144 in the nature of a utility knife constructed in accordance with another embodiment of the present invention. With specific reference to FIG. 4, the cutting tool 144 is constructed generally from an elongated U-shaped frame member 146 formed from a base 148 having a pair of spaced apart legs 150, a retractable safety cover 152, a polymeric sleeve 126 and a blade holder assembly 154 which includes a plate-like spring 156, flat rectangular plate 158 and bolt 136. The blade holder assembly 154 differs over blade holder assembly 108 essentially by the addition of spring 156.

The plate 158 is provided with a threaded opening 160 operative for threadingly receiving bolt 136. A pair of aligned spaced apart indents 162 are formed within the central region of the plate 158 extending inwardly from the edges of the plate. A pair of spaced apart punched elongated openings 164 are formed so as to provide an adjacent elongated protruding detent extending from one side of the plate. The detents 166, one arranged on either side of the indents 162, provide an area for capturing and holding the spring 156. Other than the detents 166 formed by openings 164, the plate 158 is similar in construction to plate 132 of the blade holder assembly 108.

The spring 156 is constructed from a flat plate-like member having a pair of spaced apart legs 168 and an outwardly bent centrally disposed arm 170. The spring 156 is constructed from conventional spring-like materials such that arm 170 acts as a resilient spring lever arm to apply a compressive force in operative association with plate 158 as to be described. It is, however, to be understood that other shaped springs may be employed with the blade holder assembly 154 in accordance with the present invention.

Figure 5:
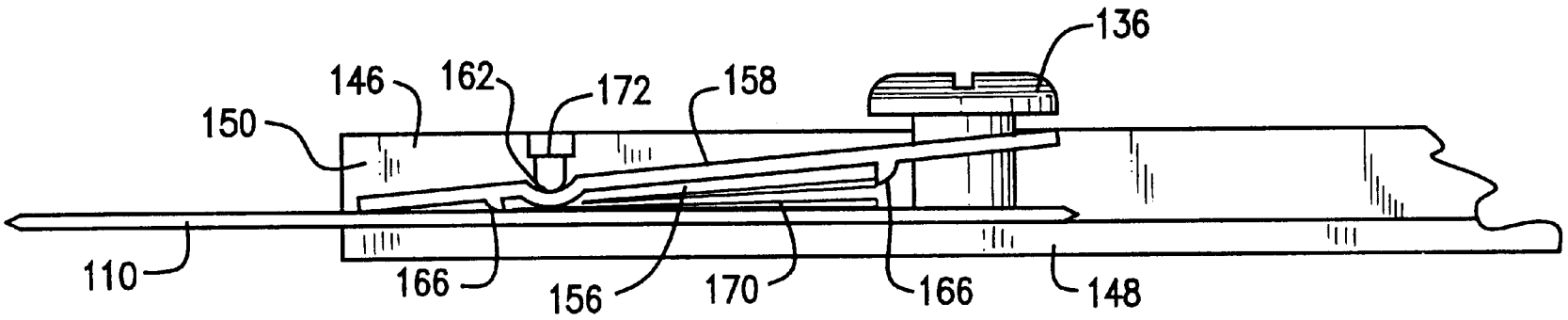
FIG. 5 is an assembled side elevational view of the blade holder assembly illustrated in FIG. 4.

The blade holder assembly 154 in assembled relationship is shown in FIG. 5. The plate 158 is pivotably coupled to the frame member 146 by pins 172, similar to pins 142, being received within the indents 162 of the plate. Spring 156 is initially positioned between the plate 158 and base 148 of the frame member 146. The spring 156 is held in position by being bound at either end by means of detents 166. Leg 170 of the spring 156 is operative for rotating the plate 158 in a counter-clockwise direction about the pins 172 such that threaded opening 160 remains spaced from base 148 of the frame member 146. The spring 156 effectively maintains cooperative engagement between indents 162 and pins 172 to prevent the plate 158 from falling out of the frame member 156 during replacement of the cutting blade 110. In this regard, it is to be understood that the spring 156 may also be incorporated within the blade holder assembly 108 as described with respect to the cutting tool 100. A cutting blade 110 is slid underlying the plate 158 between the base 148 of the frame member 146 and spring 156. The cutting blade 110 is secured by clamping same to the frame member 146 by operation of bolt 136 as previously described with respect to blade holder assembly 108. Accordingly, the specific operation of the blade holder assembly 154 will not be repeated hereat.

Referring once again to FIG. 4, there will now be described the construction of the retractable safety cover 152 which may be formed by molding from suitable polymeric material. The safety cover 152 is constructed from a base 174 having a resilient deflectable tab 176 formed by means of a U-shaped cutout 178. Projecting inwardly from the tab 176 is a pair of adjacent projecting segments 180. Extending along the inner surface of the base 174 is a groove 182 which extends also along tab 176 where it terminates adjacent one edge of the safety cover 152. The base 174 is laterally bound by a pair of sidewalls 184, 186 which have an inwardly turned projecting segment 188. A manually engageable release member 190 extends outwardly from the outer surface of tab 176 opposite to the projecting segments 180. Cooperating with the retractable safety cover 152, the base 148 of the frame member 146 is provided with pairs of spaced apart elongated openings 192 and a rearwardly projecting segment 194 formed adjacent opening 196.

Figure 6:
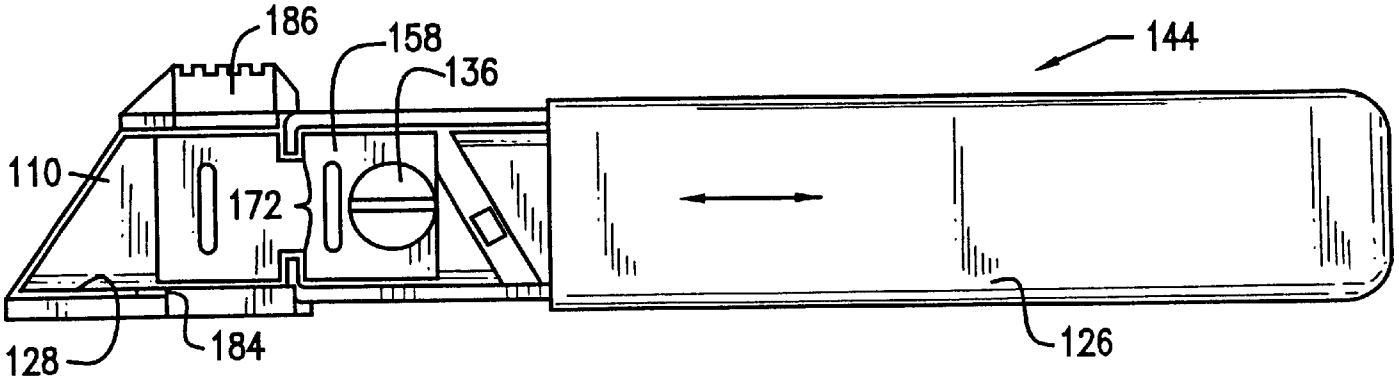
FIG. 6 is a front elevational view of the assembled utility knife shown in FIG. 4 having a retractable protective sleeve arranged in its safety position.
Figure 7:
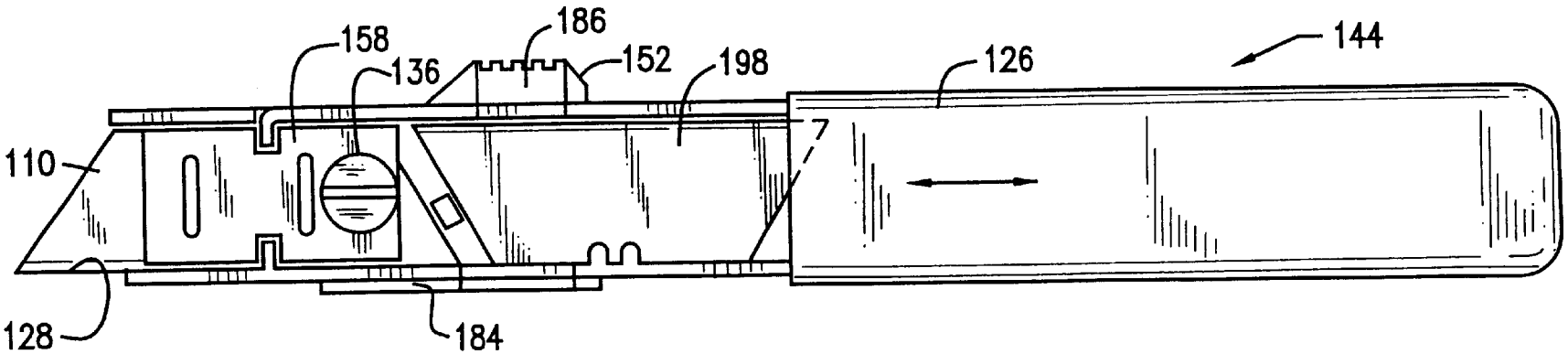
FIG. 7 is a front elevational view of the utility knife showing its protective sleeve arranged in a user position whereby the cutting edge of the blade is exposed for use.

Referring to FIGS. 6 and 7, the operation of the retractable safety cover 152 will now be described. The safety cover 152 captures overlying base 174 and between the sidewalls 184, 186 the end of the U-shaped frame member 146. Legs 150 of the frame member 146 are positioned adjacent the sidewalls 184, 186 with the segments 188 thereof projecting inwardly over the legs to slidingly secure the safety cover to the frame member 146. The projecting segment 194 is captured within groove 182 to act as a guide as the retractable safety cover 152 is slid along the frame member 146 between operative and inoperative positions.

As shown in FIG. 6, the safety cover 152 can be arranged in a safety position whereby the cutting edge 128 of the blade 110 is covered by sidewall 184. The safety cover 152 is maintained in this safety position by the projecting segments 180 on tab 176 being received within one set of openings 192. In order to retract the safety cover 152, it is first necessary to disengage the projecting segments 180 from within the openings 192. This is achieved by depressing release member 190 whereby the tab 176 is deflected away from base 148 of the frame member 146. Once the projecting segments 180 have been released from the openings 192, the safety cover, 152 may be slid along the frame member 146 so as to expose the cutting edge 128 of the cutting blade 110 as shown in FIG. 7. In this regard, the safety cover 152 may be releasably locked in an open position by the projecting segments 180 engaging the other pair of openings 192 within the base 148 of the frame member 146. Although only two pairs of openings 192 are shown, any number of such openings may be provided. Accordingly, the retractable safety cover 152 provides a convenient and easily manipulated safety cover to prevent inadvertent contact with the cutting edge 128 of the blade 110 by the user during periods of non-use. The safety cover 152 is easily retracted by initial operation of the release member 190. Due to the resilient nature of the tab 176, the tab will return to its normal position on release of the release member 190 such that projecting segments 180 will be securely received within the desired openings 192.

Referring once again to FIG. 4, a polymeric sleeve 126 is slidably received over a portion of the U-shaped frame member 146 forming a handle portion. Within this portion, a plurality of extra cutting blades 198 may be stored. The extra blades 198 are maintained in lateral relationship within the U-shaped frame member 146 by being captured between a pair of inwardly extending projections 200 formed adjacent openings 202. The extra blades 198 are maintained within the confines of U-shaped frame member 146 by being covered by sleeve 126. In this regard, the sleeve 126 may be slid laterally along the frame member 146 to provide access to the storage area of the extra blades 198. Although not specifically described, a similar arrangement for storing extra blades 198 may be provided with the cutting tool 100.

Figure 9:
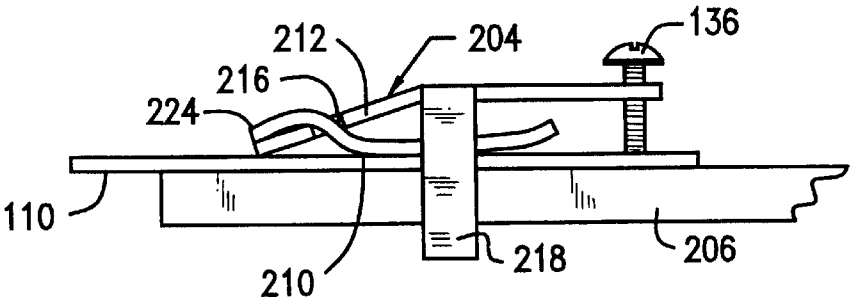
FIG. 9 is an assembled side elevational view of the blade holder assembly illustrated in FIG. 8.
Figure 8:
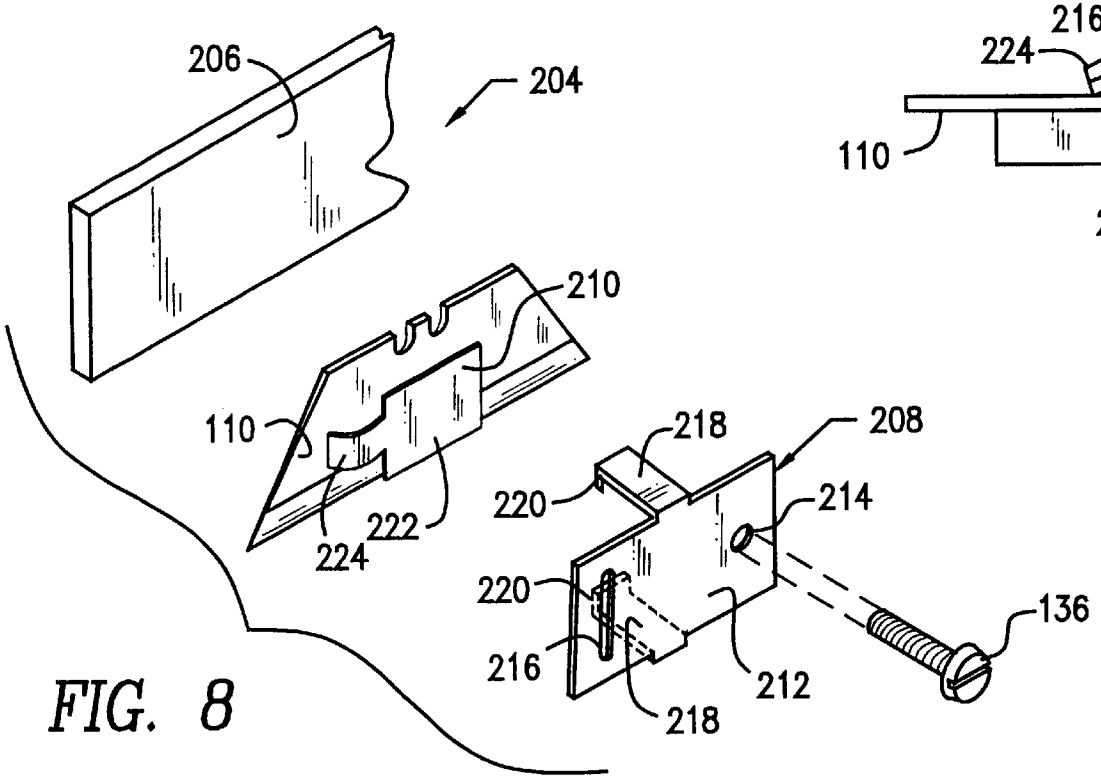
FIG. 8 is an exploded perspective unassembled view of the construction of a blade holder assembly in accordance with another embodiment of the present invention.

Referring now to FIGS. 8 and 9, there will be described another embodiment of a blade holder assembly constructed in accordance with the present invention and designated generally by reference numeral 204. The blade holder assembly 204 is particularly suitable for use with a cutting tool constructed to include a frame member 206 which has a rectangular cross section as opposed to the U-shaped frame members employed in the cutting tools 100, 144 as disclosed in FIGS. 1 and 4. In this regard, the frame member 206 is constructed of sufficient thickness so as to be useful for its intended purpose without additional reinforcement. The blade holder assembly 204 includes a pivotable plate member 208 and a spring 210. The plate member 208 includes a rectangular base 212 having a threaded opening 214 at one end thereof and an elongated opening 216 at the other end thereof. A pair of spaced apart L-shaped legs 218 are arranged extending outwardly from the opposite side edges of the base 212 at a generally central location thereof. The legs 218 are provided with inwardly turned flanges 220 opposing one another and providing an opening therebetween. The spring 210 is formed from a generally flat rectangular plate 222 from which there extends at one end a curved member 224.

Referring now to FIG. 9, the assembled relationship of the blade holder assembly 204 in securing a cutting blade 110 to the frame member 206 will now be described. Spring 210 is initially assembled to the plate member 208 by inserting the curved member 224 so as to extend through the elongated opening 216, with the plate 222 underlying the base 212 of the plate member. The plate member 208 is positioned overlying the frame member 206 such that the flanges 220 are received over the edges and engage the rear surface of the flange member 206. A cutting blade 110 is slid between the frame member 206 and spring 210. As previously described, as bolt 136 is rotated, its free end will clamp the cutting blade 110 directly to the frame member 206. At the same time, the operation of the bolt 136 will effect pivoting of the plate member 208 by virtue of legs 218 engaging the sides of the frame member 206 such that the other end of the plate member adjacent elongated opening 216 will engage and clamp the cutting blade 110 also to the frame member 206. It is to be understood that the spring 210 is also suitable for use in the blade holder assembly 108, 154.

Figure 10:
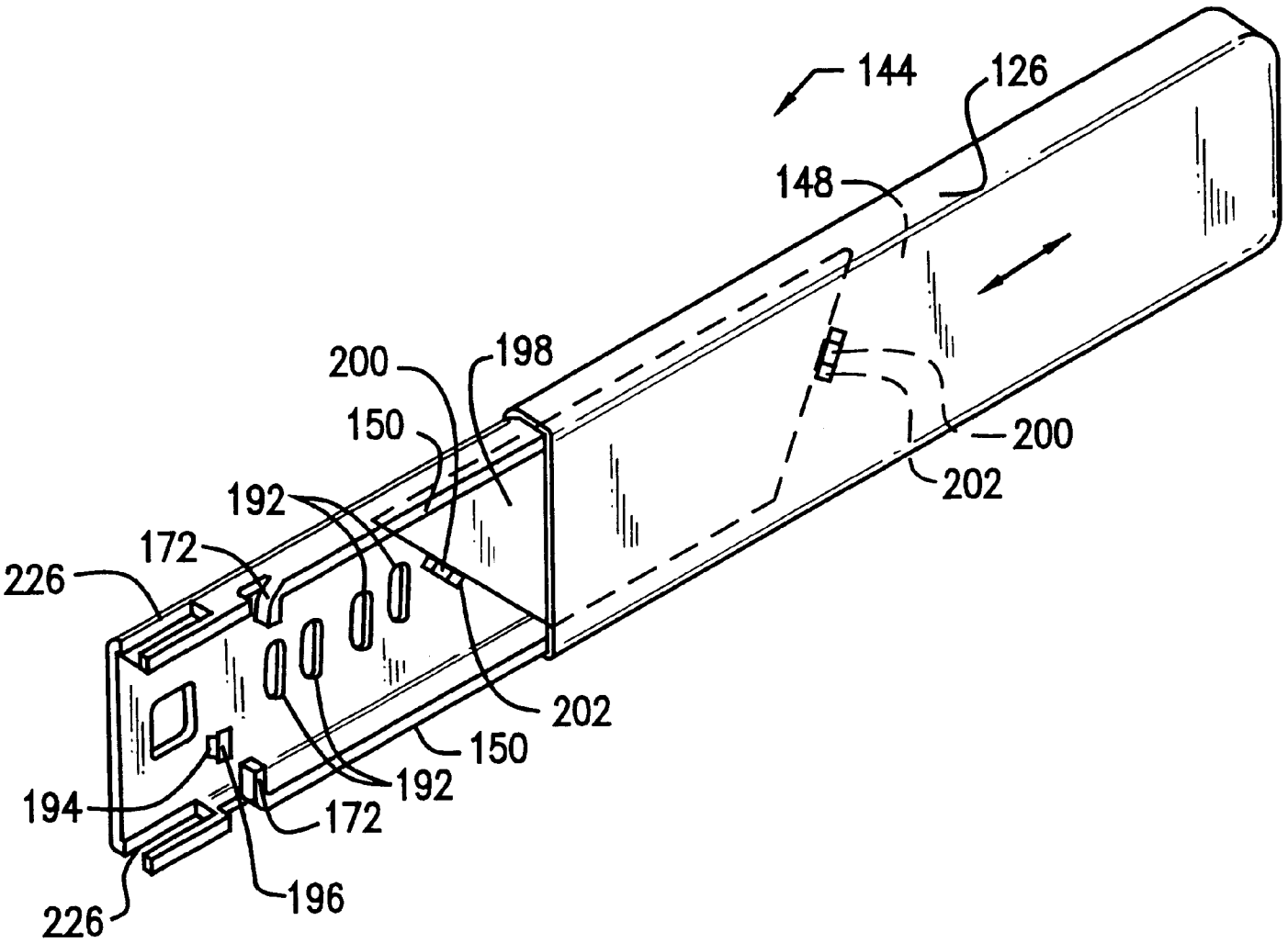
FIG. 10 is a perspective view of a portion of a utility knife having a blade holder assembly constructed in accordance with another embodiment of the present invention.
Figure 11:
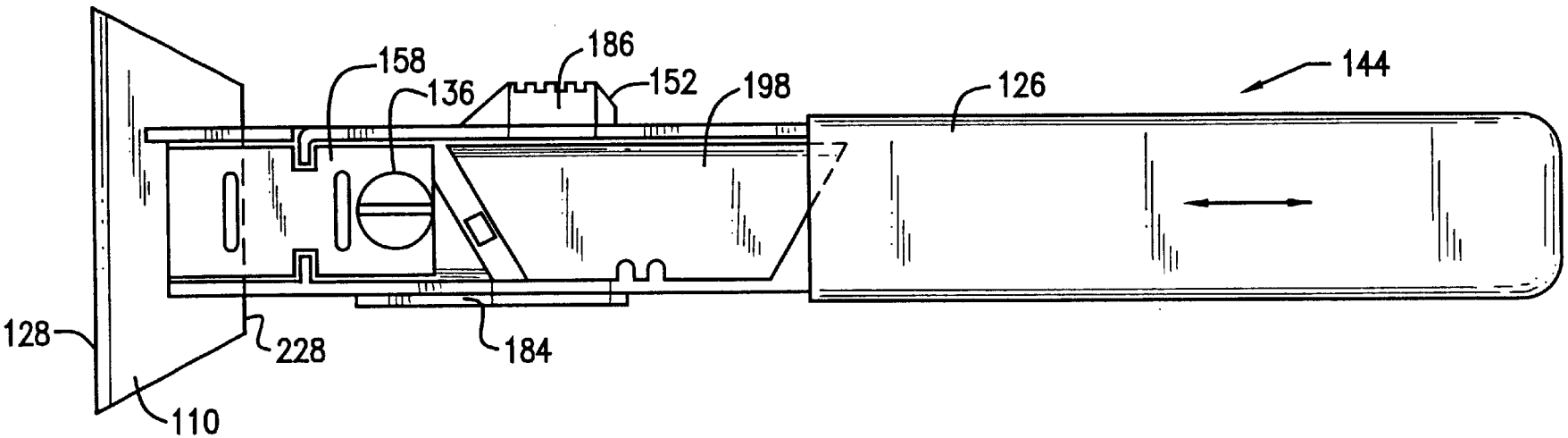
FIG. 11 is a front elevational view of a fully assembled utility knife as shown in FIG. 10 having the blade arranged for use as a scraper.
Figure 15:
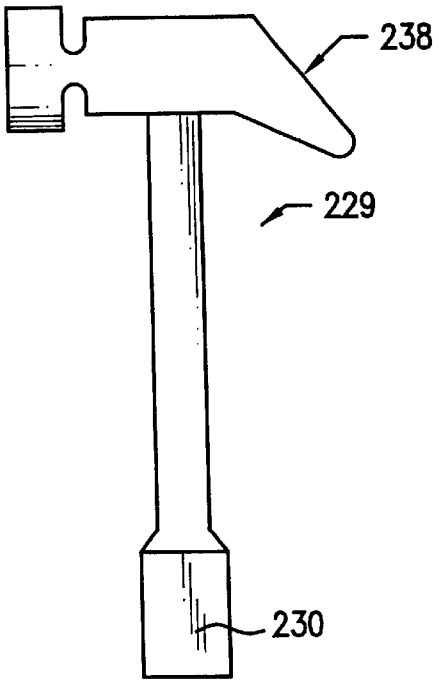
FIG. 15 is a front elevational view of a tool in the nature of a hammer.
Figure 14:
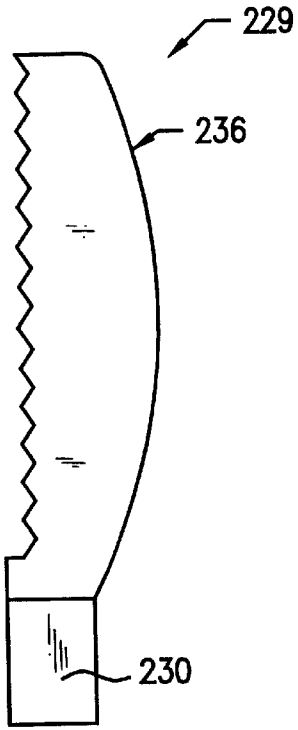
FIG. 14 is a front elevational view of a tool in the nature of a saw.
Figure 13:
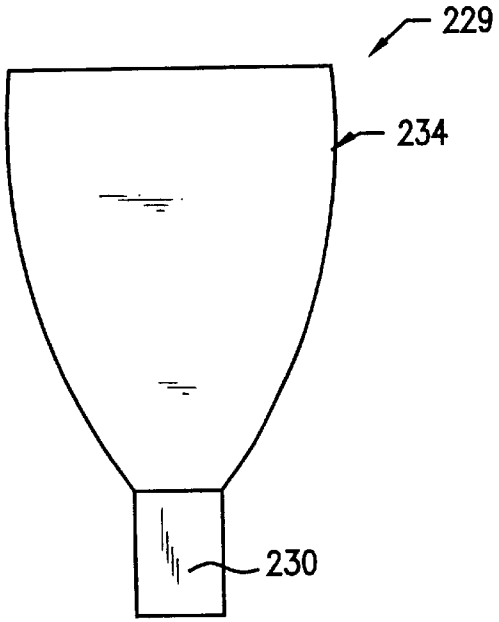
Figure 12:
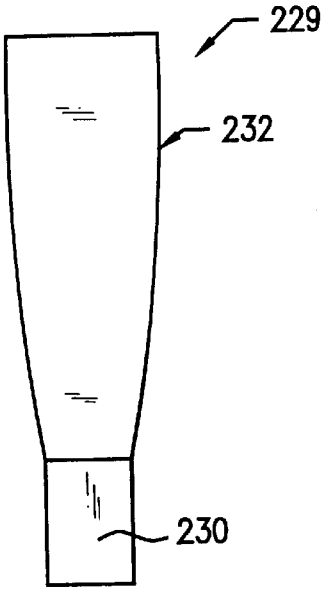
FIG. 12 is a front elevational view of a tool in the nature of a narrow scraper.
Figure 20:
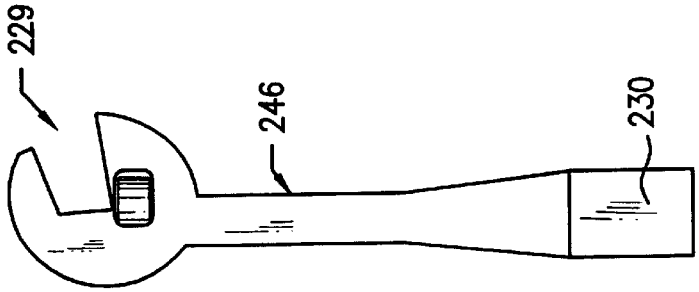
FIG. 20 is a front elevational view of a tool in the nature of a wrench.
Figure 19:
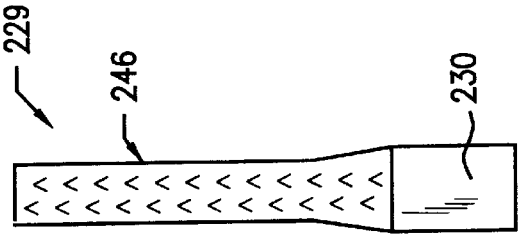
FIG. 19 is a front elevational view of a tool in the nature of a rasp.
Figure 18:
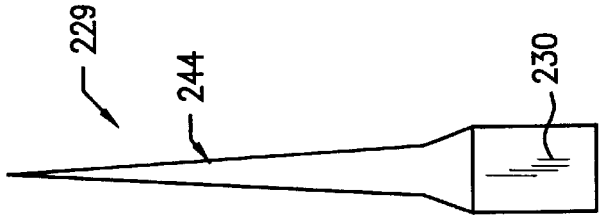
FIG. 18 is a front elevational view of a tool in the nature of an awl.
Figure 17:
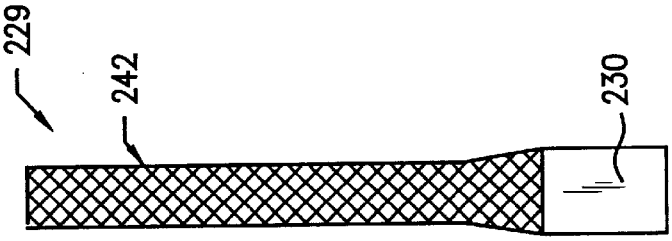
FIG. 17 is a front elevational view of a tool in the nature of a file.
Figure 16:
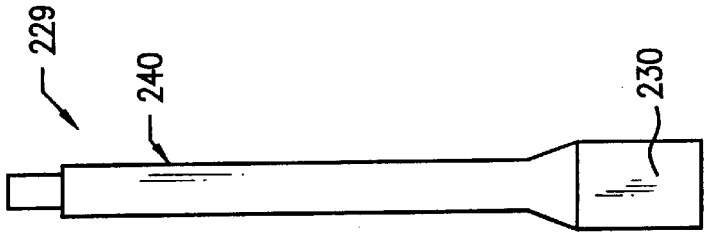
FIG. 16 is a front elevational view of a tool in the nature of a screw driver.

Referring now to FIG. 10, there is illustrated another embodiment of the present invention. In this regard, there is illustrated a cutting tool 144 as previously disclosed and described with reference to FIGS. 4–7. The difference between the two embodiments resides in the spaced apart legs 150 being provided with elongated openings 226 at the free forward end of the frame member 146. The openings 226 enable the repositioning of the cutting blade 110 from its arrangement as shown in FIG. 7 to its arrangement as shown in FIG. 11.

Specifically, the FIG. 7 arrangement discloses the cutting blade 110 arranged having its cutting edge 128 parallel to the longitudinal axis of the frame member 146. In this manner, the cutting tool 144 will function as a conventional utility knife. In the FIG. 11 arrangement, the blunt edge 228 of the cutting blade 110 opposing the cutting edge 128 is received within the spaced apart elongated openings 226. This arranges the cutting edge 128 transverse to the longitudinal axis of the frame member 146. In the FIG. 11 arrangement, the cutting blade 110 can function as a conventional scraper. Accordingly, the cutting tool by virtue of the elongated openings 226 enables the utility knife to function as same, as well as a scraper by repositioning the cutting blade 110 as shown in FIG. 11. It is to be understood that any one of the blade holder assemblies 104, 154, 204 may be utilized for securing the cutting blade 110 in the scraper position as shown in FIG. 11.

In addition to securing a cutting blade 110, the blade holder assemblies 104, 154, 204 are operative in the manner of a tool handle assembly for securing any flat plate-like member. By way of example, a plurality of tools 229 having multiple purposes may be provided with a shank 230 in the nature of such a flat plate-like member. Referring to FIGS. 12–20, there is illustrated a narrow scraper 232, a wide scraper, 234, a saw 236, a hammer 238, a knife or Phillips screw driver 240, a file 242, an awl 244, a rasp 246 and a wrench 248, each including a shank 230. Other tools not illustrated which are operative for performing different functions which include a similar shank 230 are also contemplated to be within the scope of the present invention.

Figure 21:
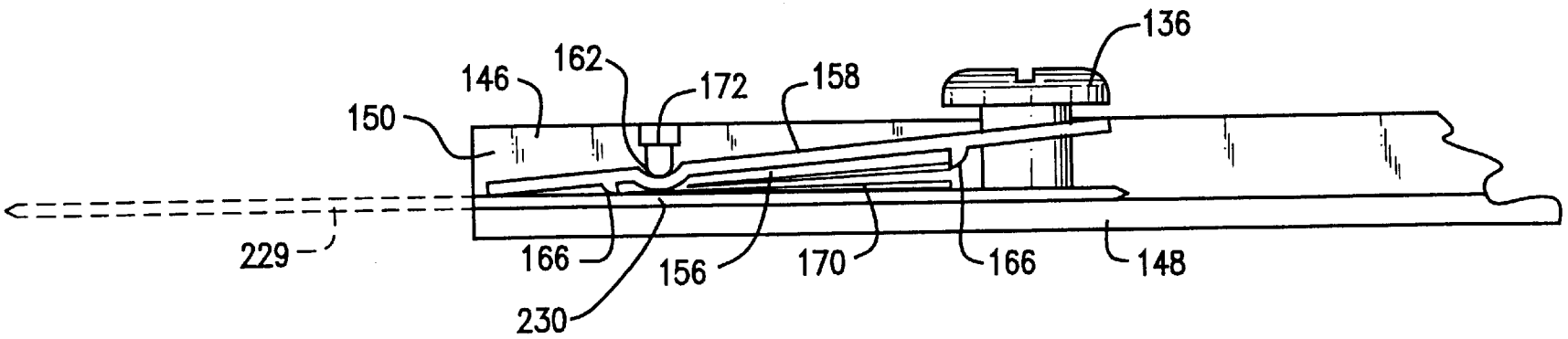
FIG. 21 is an assembled side elevational view of a tool handle assembly operative for ready attachment and/or replacement of any one of a plurality of tools each having the same or different function.

Each of the aforementioned tools are secured by means of any one of the blade holder assemblies 108, 154, 204 clampingly engaging the shank 230 as previously described and as further illustrated in FIG. 21. In this manner, any one of the tools may be replaced with another tool in the same manner as the cutting blade 110 can be replaced as previously described through the operation of any one of the blade holder assemblies 108, 154, 204 which functions as a tool handle assembly. In the example illustrated in FIG. 21, the shank 230 of the narrow scraper 232 is inserted between the base 148 and plate 158. As bolt 136 is rotated, its free end will engage a portion of the shank 230 causing the plate 158 to pivot about pins 172 until the opposite end of the plate also engages the shank. At this point, further rotation of the bolt 136 will press the underlying portion of the shank 230 firmly against the base 148. Simultaneously, the pivoting action of the plate 158 will press the other end of the plate against another portion of the shank 230 so as to securely clamp the tool in position for use. The tool may be removed and replace with another tool by simple reverse rotation of the bolt 136.

The tools 229 may be provided in the nature of a kit as a multi-purpose tool kit. The kit may include any number of the plurality of tools 229 along with a handle, such as one constructed from a frame member 146 supporting one of the blade holder assemblies 108, 154, 204. In this manner, a single tool handle will accommodate any one of a plurality of tools 229.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. A multi-purpose tool assembly, said assembly comprising a frame member, a tool having a shank removably supported on said frame member, a plate coupled to said frame member arranged overlying at least a portion of said shank, a spring arranged between said shank and said plate in engagement therewith, and securing means in operative association with said plate for releasably clamping said shank against said frame member by engagement of at least a portion of said plate with said shank, whereby said tool can be replaced with another tool having a shank by operation of said securing means.

2. The tool assembly of claim 1, wherein said plate is pivotably coupled to said frame member about a pivot point arranged between the ends of said plate.

3. The tool assembly of claim 1, wherein said securing means is arranged adjacent one end of said plate, said securing means having a portion thereof engaging said shank for clamping said shank thereat to said frame member while pivoting said plate for engaging another end of said plate with said shank for clamping said shank thereat to said frame member.

4. The tool assembly of claim 1, wherein said securing means comprises a bolt threadably received within said plate.

5. The tool assembly of claim 1, wherein said plate includes a pair of spaced apart detents, said detents maintaining the position of said spring therebetween.

6. The tool assembly of claim 1, wherein said plate includes a pair of spaced apart legs engaging the sides of said frame member for pivotable movement therebetween.

7. The tool assembly of claim 1, wherein said frame member comprises a U-shaped member.

8. The tool assembly of claim 1, wherein said tool and said shank are integrally formed.

9. The tool assembly of claim 8, wherein said shank comprises a flat plate-like member.

10. A multi-purpose tool assembly, said assembly comprising a U-shaped frame member, a tool having a shank removably supported on said frame member, a plate pivotably coupled to said frame member overlying at least a portion of said shank, a spring arranged between said shank and said plate and a bolt threadably received through one end of said plate for releasably clamping said shank against said frame member, said bolt having a portion engaging said shank while pivoting said plate such that another end of said plate engages said shank thereby clamping said shank to said frame, whereby said tool can be replaced with another tool having a shank by operation of said securing means.

11. The tool assembly of claim 10, wherein said plate includes a pair of spaced apart detents, said detents maintaining the position of said spring therebetween.

12. The tool assembly of claim 10, wherein said plate includes a pair of spaced apart legs engaging the sides of said frame member for pivotable movement therebetween.

13. The tool assembly of claim 10, wherein said frame member includes a pair of opposing pins engaging said plate for pivotable movement of said plate with respect to said pins.

14. The tool assembly of claim 10, wherein said frame comprises a tool handle.

15. A multi-purpose tool kit, said kit comprising a frame member, a plurality of tools each having a shank, said tools being separately and removably supported on said frame member, a plate coupled to said frame member arranged overlying at least a portion of said shank, a spring arranged between said shank and said plate in engagement therewith, and securing means in operative association with said plate for releasably clamping said shank against said frame member by engagement of at least a portion of said plate with said shank, whereby one of said plurality of tools can be replaced with another one of said plurality of tools by operation of said securing means.

16. The tool kit of claim 15, wherein said plate is pivotably coupled to said frame member about a pivot point arranged between the ends of said plate.

17. The tool kit of claim 15, wherein said securing means is arranged adjacent one end of said plate, said securing means having a portion thereof engaging said shank for clamping said shank thereat to said frame member while pivoting said plate for engaging another end of said plate with said shank for clamping said shank thereat to said frame member.

18. The tool kit of claim 15, wherein said securing means comprises a bolt threadably received within said plate.

19. The tool kit of claim 15, wherein said plate includes a pair of spaced apart detents, said detents maintaining the position of said spring therebetween.

20. The tool kit of claim 15, wherein said plate includes a pair of spaced apart legs engaging the sides of said frame member for pivotable movement therebetween.

21. The tool kit of claim 15, wherein said frame member comprises a U-shaped member.

22. The tool kit of claim 15, wherein said tool and said shank are integrally formed.

23. The tool kit of claim 15, wherein said shank comprises a flat plate-like member.

24. The tool kit of claim 15, wherein said frame member includes a pair of opposing pins engaging said plate for pivotable movement of said plate with respect to said pins.

* * * * *